US011044976B1

(12) United States Patent
Debro

(10) Patent No.: US 11,044,976 B1
(45) Date of Patent: Jun. 29, 2021

(54) SELF-CONTAINED ARTISTIC SYSTEM

(71) Applicant: Ruth Carla Debro, San Juan Capistrano, CA (US)

(72) Inventor: Ruth Carla Debro, San Juan Capistrano, CA (US)

(73) Assignee: CAPITAL LUX INVESTMENTS LLC, Orem, UT (US)

( * ) Notice: Subject to any disclaimer, the term of this patent is extended or adjusted under 35 U.S.C. 154(b) by 175 days.

(21) Appl. No.: 16/387,239

(22) Filed: Apr. 17, 2019

Related U.S. Application Data

(60) Provisional application No. 62/797,328, filed on Jan. 27, 2019.

(51) Int. Cl.
*A45C 11/36* (2006.01)
*B44D 3/00* (2006.01)
*A45C 13/02* (2006.01)

(52) U.S. Cl.
CPC ..... *A45C 11/36* (2013.01); *A45C 13/02* (2013.01); *B44D 3/00* (2013.01)

(58) Field of Classification Search
CPC ..... A45C 13/02; A45C 11/36; A45C 3/02; B44D 3/00; B44D 3/04; B41L 13/005; B41L 3/005; A63H 3/005; A63H 3/00
USPC ..... 206/1.7, 575, 373, 457
See application file for complete search history.

(56) References Cited

U.S. PATENT DOCUMENTS 791,506 A * 6/1905 Simmons ..... A47B 53/02 312/200
3,352,616 A * 11/1967 Linger ..... B44D 3/02 312/231
4,061,224 A * 12/1977 Fuhri ..... B44D 3/04 206/1.7
4,294,348 A * 10/1981 Hastings ..... B25H 3/02 206/1.7
4,372,630 A * 2/1983 Fuhri ..... A47B 97/08 206/1.7
4,753,346 A * 6/1988 Tsuji ..... A45C 11/36 206/224
5,163,547 A * 11/1992 Hsieh ..... B44D 3/00 206/1.7

(Continued)

OTHER PUBLICATIONS

Website for Imagee Caddee, accessed Apr. 25, 2019, https://www.imageecaddee.com/ (6 pgs).

(Continued)

*Primary Examiner* — Chun Hoi Cheung
(74) *Attorney, Agent, or Firm* — Hayes Soloway P.C.

(57) ABSTRACT

A self-contained artistic storage and creation apparatus includes a housing having a volume defined by a width, length, and depth. At least one drawer is slidably located within the housing and is substantially the depth of the housing. The at least one drawer is sized to contain artistic supplies. A first writing surface is slidably located on an exterior surface of the housing. A second writing surface is slidably located within the housing. The second writing surface is accessible by sliding the first writing surface from a first writing position to a second writing position. A cavity is located within the housing and between the first and second writing surfaces. The cavity is substantially the length and depth of the housing. The cavity is accessible by sliding at least one from the set of: the first writing surface and the second writing surface.

20 Claims, 10 Drawing Sheets

(56) References Cited

U.S. PATENT DOCUMENTS

| | | | | | |
|---|---|---|---|---|---|
| 5,234,108 | A * | 8/1993 | Jorgensen | A45C 11/36 | 206/1.7 |
| 5,284,445 | A * | 2/1994 | Dietterich | B43L 1/00 | 434/408 |
| 5,855,351 | A * | 1/1999 | Cziraky | A47B 97/04 | 248/451 |
| 6,026,960 | A * | 2/2000 | Cogliano | A63H 3/005 | 206/457 |
| 6,045,108 | A * | 4/2000 | Cziraky | A45C 9/00 | 248/454 |
| 6,164,976 | A * | 12/2000 | Wilson | B43K 23/001 | 434/365 |
| 6,382,421 | B1 * | 5/2002 | Dao | A45C 11/36 | 206/1.7 |
| 10,093,477 | B2 * | 10/2018 | Di Bona | B65D 85/68 | |

OTHER PUBLICATIONS

YouTube video for Imageecadee, accessed Apr. 25, 2019, https://www.youtube.com/watch?v=jzLXZOGmjUc (2 pgs).

* cited by examiner

SELF-CONTAINED ARTISTIC SYSTEM

CROSS REFERENCE TO RELATED APPLICATION

This application claims benefit of U.S. Provisional Application Ser. No. 62/797,328 filed Jan. 27, 2019, entitled "Instruction and Display System and Method for Elementary Education," the entire disclosure of which is incorporated herein by reference.

FIELD OF THE DISCLOSURE

The present disclosure is generally related to systems of artistic supplies and more particularly is related to self-contained artistic storage systems.

BACKGROUND OF THE DISCLOSURE

Young children can learn and develop numerous skills from creating art in a physical medium, including creativity, motor skills, visual processing, decision-making, focus, and perseverance. Artistic creation can also be an excellent activity for entertaining children. Art in physical media may include painting, drawing with pencils, chalk, crayons, or markers, writing, folding paper, and the like.

Young children can often benefit from entertaining activities performed while away from home, when they have periods of open time that may leave them bored. It can be difficult to store multiple different types of artistic supplies together along with the materials and media needed to create them. Moreover, it can be difficult to transport multiple different types of artistic supplies to these locations outside the home.

Thus, a heretofore unaddressed need exists in the industry to address the aforementioned deficiencies and inadequacies.

SUMMARY OF THE DISCLOSURE

Embodiments of the present disclosure provide an apparatus for artistic storage and creation. Briefly described, in architecture, one embodiment of the apparatus, among others, can be implemented as follows. A self-contained artistic storage and creation apparatus includes a housing having a volume defined by a width, length, and depth. At least one drawer is slidably located within the housing and is substantially the depth of the housing. The at least one drawer is sized to contain artistic supplies. A first writing surface is slidably located on an exterior surface of the housing. A second writing surface is slidably located within the housing. The second writing surface is accessible by sliding the first writing surface from a first writing position to a second writing position. A cavity is located within the housing and between the first and second writing surfaces. The cavity is substantially the length and depth of the housing. The cavity is accessible by sliding at least one from the set of: the first writing surface and the second writing surface.

The present disclosure can also be viewed as providing an apparatus for artistic storage and creation. Briefly described, in architecture, one embodiment of the apparatus, among others, can be implemented as follows. A self-contained artistic storage and creation apparatus having the appearance of an elephant includes a housing shaped as an elephant. The housing has a volume defined by a width, length, and depth. A first drawer is shaped as the elephant's front feet and is substantially the depth of the housing. A second drawer is shaped as the elephant's rear feet and is substantially the depth of the housing. A hook is shaped as the elephant's tail. A drawer is shaped as at least a portion of the elephant's trunk. A writing surface is shaped as the elephant's body and slidably located on an exterior surface of the housing. A cavity is located within the housing and directly interior to the writing surface. The cavity is substantially the length and depth of the housing. The cavity is accessible by sliding the writing surface.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
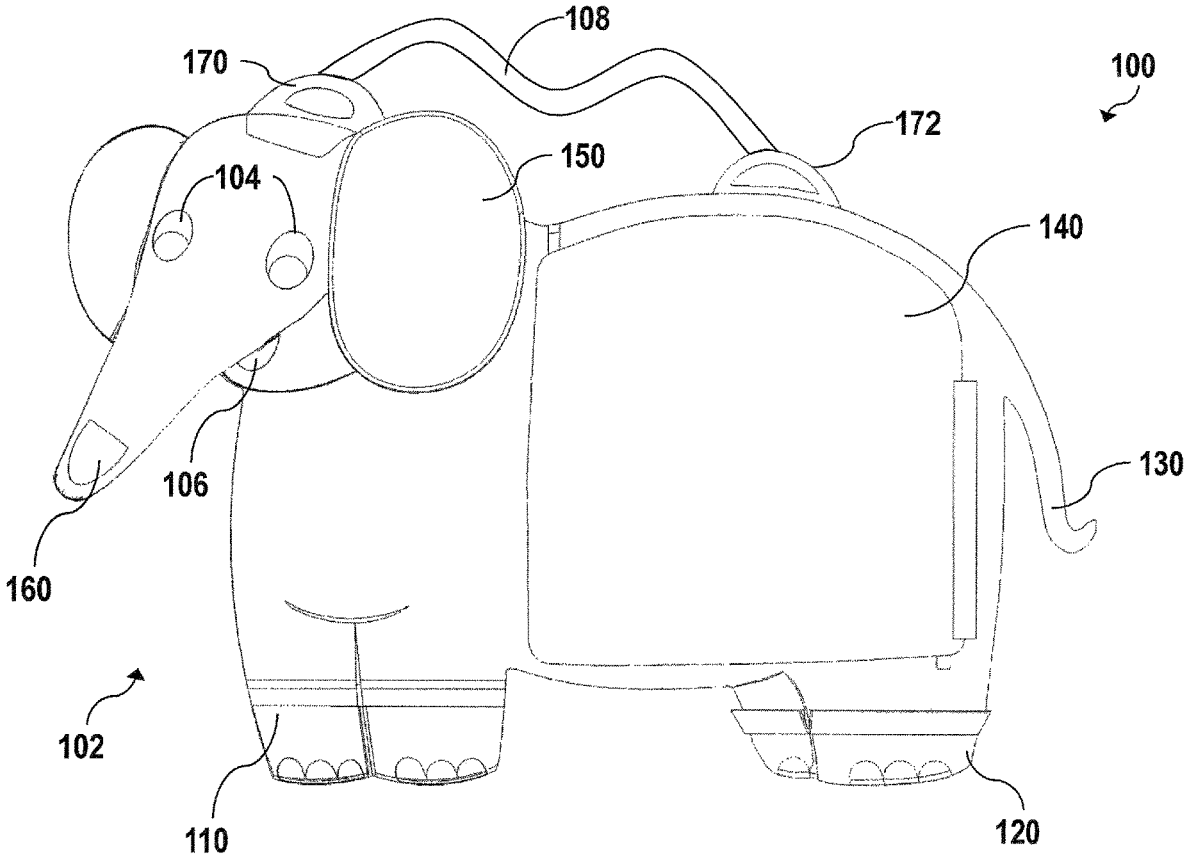
FIG. 1 is a cross-sectional front illustration of a self-contained artistic storage and creation apparatus, in accordance with a first exemplary embodiment of the present disclosure.

FIG. 1 is a cross-sectional front illustration of a self-contained artistic storage and creation apparatus 100 (hereinafter "apparatus 100"), in accordance with a first exemplary embodiment of the present disclosure. The apparatus

Figure 3:
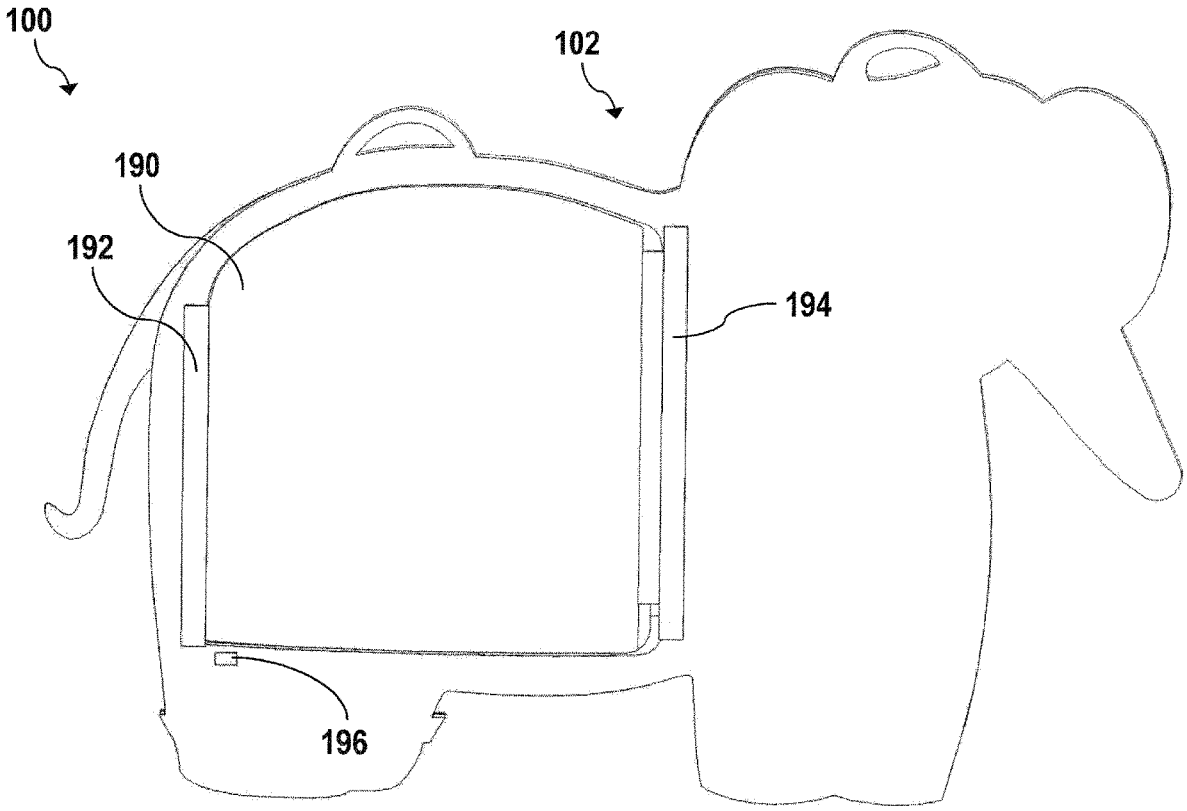
FIG. 3 is a cross-sectional rear illustration of the apparatus of FIG. 1, in accordance with the first exemplary embodiment of the present disclosure.
Figure 4:
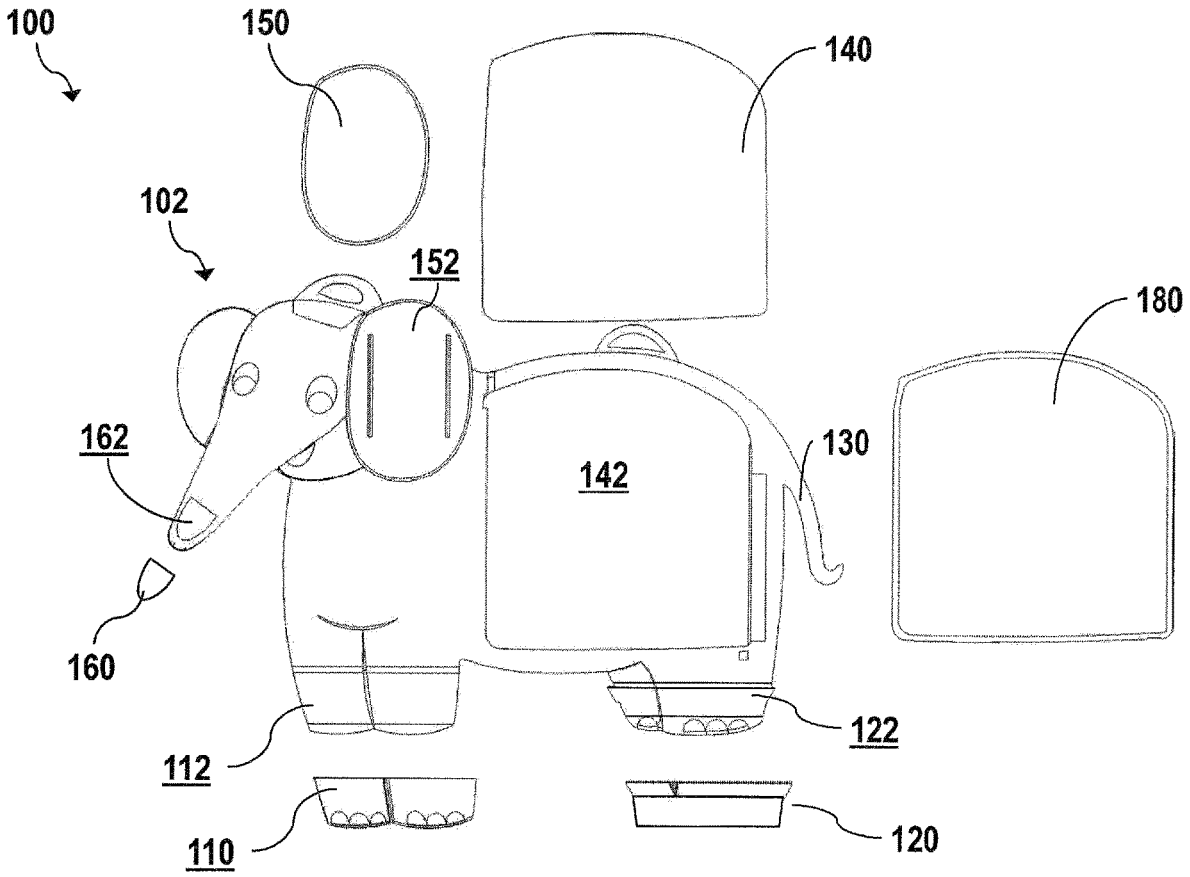
FIG. 4 is an exploded view of the apparatus of FIG. 1, in accordance with the first exemplary embodiment of the present disclosure.
Figure 5A:
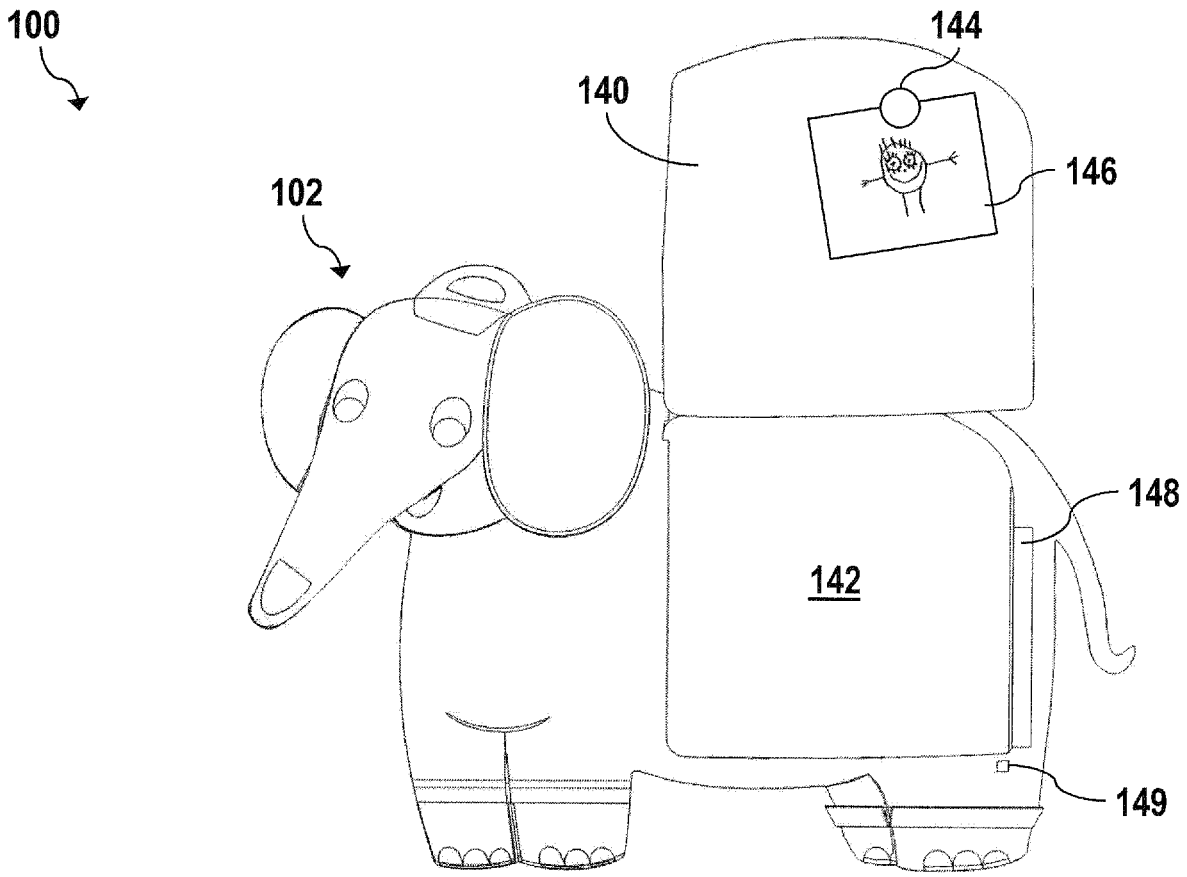
FIG. 5A is a front view illustration showing the interior of the apparatus of FIG. 1, in accordance with the first exemplary embodiment of the present disclosure.
Figure 5B:
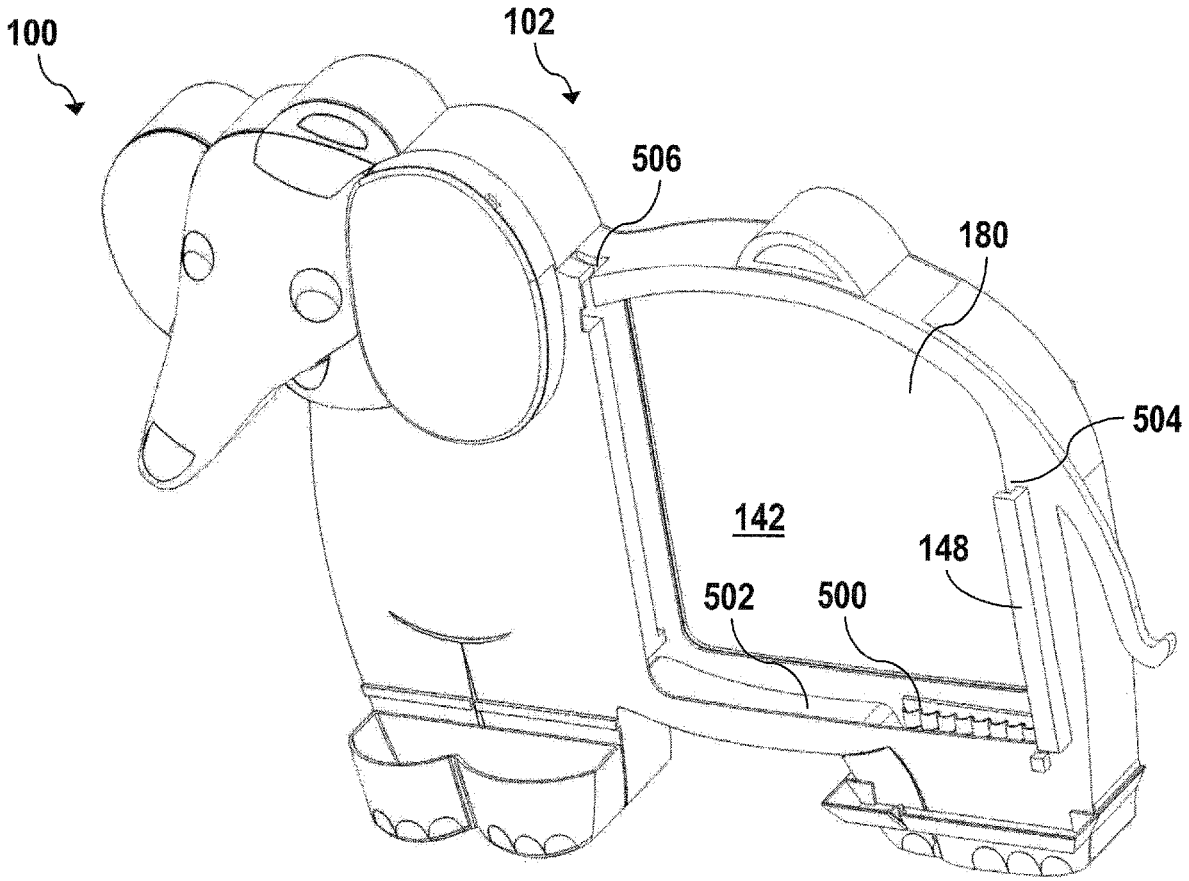
FIG. 5B is an isometric illustration showing the interior of the apparatus of FIG. 1, in accordance with the first exemplary embodiment of the present disclosure.

100 includes a housing 102 having a volume defined by a width, length, and depth. At least one drawer 110, 120 is slidably located within the housing 102 and is substantially the depth of the housing 102. The at least one drawer 110, 120 is sized to contain artistic supplies. A first writing surface 140 is slidably located on an exterior surface of the housing 102. A second writing surface, shown in FIG. 3, is slidably located within the housing 102. The second writing surface is accessible by sliding the first writing surface 102 from a first writing position to a second writing position. A cavity, shown in FIGS. 4-5B, is located within the housing 102 and between the first and second writing surfaces.

The cavity is substantially the length and depth of the housing 102. The cavity is accessible by sliding at least one from the set of: the first writing surface 140 and the second writing surface.

In one example, the apparatus 100 may be shaped as an elephant. When shaped as an elephant, the apparatus 100 may be described, particularly, as follows: A self-contained artistic storage and creation apparatus 100 having the appearance of an elephant includes a housing 102 shaped as an elephant. The housing 102 has a volume defined by a width, length, and depth. A first drawer 110 is shaped as the elephant's front feet and is substantially the depth of the housing 102. A second drawer 120 is shaped as the elephant's rear feet and is substantially the depth of the housing 102. A hook 130 is shaped as the elephant's tail. A drawer 160 is shaped as at least a portion of the elephant's trunk. A writing surface 140 is shaped as the elephant's body and slidably located on an exterior surface of the housing 102. A cavity, shown in FIGS. 4-5A, is located within the housing 102 and directly interior to the writing surface 140. The cavity is substantially the length and depth of the housing 102. The cavity is accessible by sliding the writing surface 140.

In the following disclosure, the apparatus 100 may be discussed as an apparatus 100 having a housing 102 of any general shape or in the particular shape of an elephant. The elephant shape may be one specific implementation of the apparatus 100, but the disclosure is not so limited.

The apparatus 100 includes a housing 102 having a volume defined by a width, length, and depth. The housing 102 may be any suitable size, shape, and volume. In one example, the housing 102 may be shaped as an elephant having a head with eyes 104 and a mouth 106, a trunk, front feet, rear feet, stomach, and tail. In another example, the housing 102 may be shaped as any other animal or object. The shape of the housing 102 may be attractive and familiar to young children, for instance, as common animals, objects, children's characters, persons, and the like. Some exemplary shapes may include giraffes, lions, bears, hippopotamuses, castles, railroad trains, fruits, and vegetables. The housing 102 may be sized to be usable by a young child. In one example, the housing may be about 21 inches wide, about 14 inches long, and about 2.5 inches deep. The particular dimensions of the housing 102 may vary in relation to the implemented shape of the housing 102, but may remain suitable to allow young children to hold, carry, use, and reach all of the component elements. The housing 102 may be made from any suitable materials, including plastic, wood, metal, ceramic, polymer, fabric, or any combination thereof. For example, a portion of the housing 102 may be made from a structural material, such as plastic, and a portion of the housing 102 may be made from a different material. In one example, the different material may provide tactile or textural experiences for the user. For instance, a portion of the housing 102 made to feel like elephant skin may teach a child user about texture.

The apparatus 100 may include a strap 108 attachable to first and second points on the housing 102. The strap 108 may enable a user to carry the apparatus 100 while traveling. The strap 108 may be made from any suitable material, including fabric, plastic, rope, fibers, polymer, and the like. The strap 108 may be permanently attached to the apparatus 100 or may be removable. In one example, the strap 108 may attach at a first and second handle 170, 172, which may be grippable portions of the housing 102 that allow a user to hold and maneuver the apparatus 100. In one example, the first handle 170 may resemble a hat placed upon the head of the elephant. The hat may have a space for the user to put their name in writing. In another example, the apparatus 100 may only have one handle 172, which may be located at any suitable place along the housing 102 to provide a balanced handling of the apparatus 100. In one example, the handles 170, 172 may allow the apparatus 100 to be hung on a wall when not in use. This may allow the user to display art they have created using the apparatus 100 as well as providing an easy structure for storage. The apparatus 100 may additionally be hung from the strap 108.

At least one drawer 110, 120 is slidably located within the housing 102 and is substantially the depth of the housing 102. The at least one drawer 110, 120 is sized to contain artistic supplies. The artistic supplies may include crayons, markers, pencils, pens, chalk, erasers, paints, brushes, and the like. The at least one drawer 110, 120 may be located in any suitable portion of the housing 102. Where the housing 102 is shaped as an animal, the at least one drawer 110, 120 may be shaped as a portion of the animal, for instance, a foot, an ear, a head, an arm, and the like. Where the housing 102 is shaped as another object, the at least one drawer 110, 120 may be shaped as a portion of that object, for instance, a window or a door in a house, a leaf on a plant, and so on. The at least one drawer 110, 120 may be slidably extendable from the housing 102. When extended the at least one drawer 110, 120 may extend substantially the entirety of the depth of the at least one drawer 110, 120 to allow the user to access the interior of the at least one drawer 110, 120. The at least one drawer 110, 120 may be located along a track, which may guide the extension of the at least one drawer 110, 120. In one example, the at least one drawer 110, 120 may be removable for care and cleaning of the apparatus 100. In another example, the at least one drawer 110, 120 may be lockingly stopped at the end of its extension to prevent a user from losing the drawer 110, 120 by removing it from the housing 102. In one example, the drawers 110, 120 may be differently sized to accommodate different art supplies therein. For instance, a first drawer 110 may have a first size directed to storing smaller items such as crayons, erasers, stickers, paints, and the like. The first drawer 110 may only be a few inches long. A second drawer 120 may have a second size directed to storing larger items, such as pens, pencils, brushes, markers, and the like. The second drawer 120 may be several inches long, and may be longer than the first drawer 110. The at least one drawer 110, 120 may have a bowed, curved, or angled face that extends past the front surface of the housing 102 when the drawer 110, 120 is closed. This may make it easier for a younger user to grab and open the drawer 110, 120. This is shown in greater detail in FIG. 2, below.

In the elephant example, the apparatus 100 may include at least three drawers, including a drawer 110 shaped as the elephant's front feet, a drawer 120 shaped as the elephant's rear feet, and a drawer 160 shaped as at least a portion of the elephant's trunk. The drawers 110, 120 shaped as feet may be located at a lower portion of the housing 102, where an elephant's feet are generally located. In one example, the front feet may be shaped as a single drawer 110, and the rear feet may be shaped as a single drawer 120. In another example, each foot may be a separate drawer 110, 120 and may be separately slidable. When closed, the drawers 110, 120 may be substantially flat with a front face of the elephant housing 102. As discussed above, a portion of the drawers 110, 120 may extend away from the housing 102 in order to assist a user in opening the drawers 110, 120.

The elephant's trunk may also include a drawer 160 occupying at least a portion of the trunk's volume. The drawer 160 may be slidably extendable from the trunk and may have substantially the thickness of the trunk. In one example, the drawer 160 may be sized to house chalk, crayons, and other smaller artistic supplies. In another example, the drawer 160 may extend through a substantial portion of the trunk, and may be sized to house pens, pencils, brushes, and the like.

A first writing surface 140 is slidably located on an exterior surface of the housing 102. The first writing surface 140 may be a flat or substantially flat surface that may allow a user to write, draw, sketch, color, paint, or otherwise create physical art. In one example, the first writing surface 140 may be a dry erase board on which a user may use dry erase markers to create art. In another example, the first writing surface 140 may be a chalk board, erasable paper, removable paper, magnetic sketch board, or any combination thereof. When the first writing surface 140 is a dry erase board, the first writing surface 140 may additionally be magnetic. As used in the context of this disclosure, "writing" may broadly mean to mark on a surface. Therefore, the first writing surface 140 may be a surface that allows marking. This does not include plastics, wood, or other materials generally, which are not intended to be marked upon. The writing surface 140 may be a surface specially prepared for marking, either erasably or disposably. The first writing surface 140 may cover at least a portion of the housing 102. In one example, the first writing surface 140 may cover a substantial portion of the housing 102. In the elephant example, the first writing surface 140 may resemble the elephant's stomach, side, or back, which may be generally referred to as the elephant's stomach. In this example, the first writing surface 140 may be a dry erase board for use with dry erase markers and having a magnetic surface.

A second writing surface, shown in FIG. 3, is slidably located within the housing 102. A cavity, shown in FIGS. 4-5B, is located within the housing 102 and between the first and second writing surfaces.

The apparatus 100 may include additional cavities for storing supplies. In the elephant example, the apparatus 100 may include a cavity behind a surface 150 shaped as the elephant's ear. This is discussed in greater detail in FIGS. 6A-6B, below.

The hook 130 may allow a user to hang artwork, small bags, or other hanging items from the apparatus 100. In the elephant example, the hook 130 may be shaped as the elephant's tail. The hook 130 may have a generally concave shape to allow the user to hang artwork or other items, such as necklaces, string projects, straps, and the like, from the apparatus 100.

Figure 2:
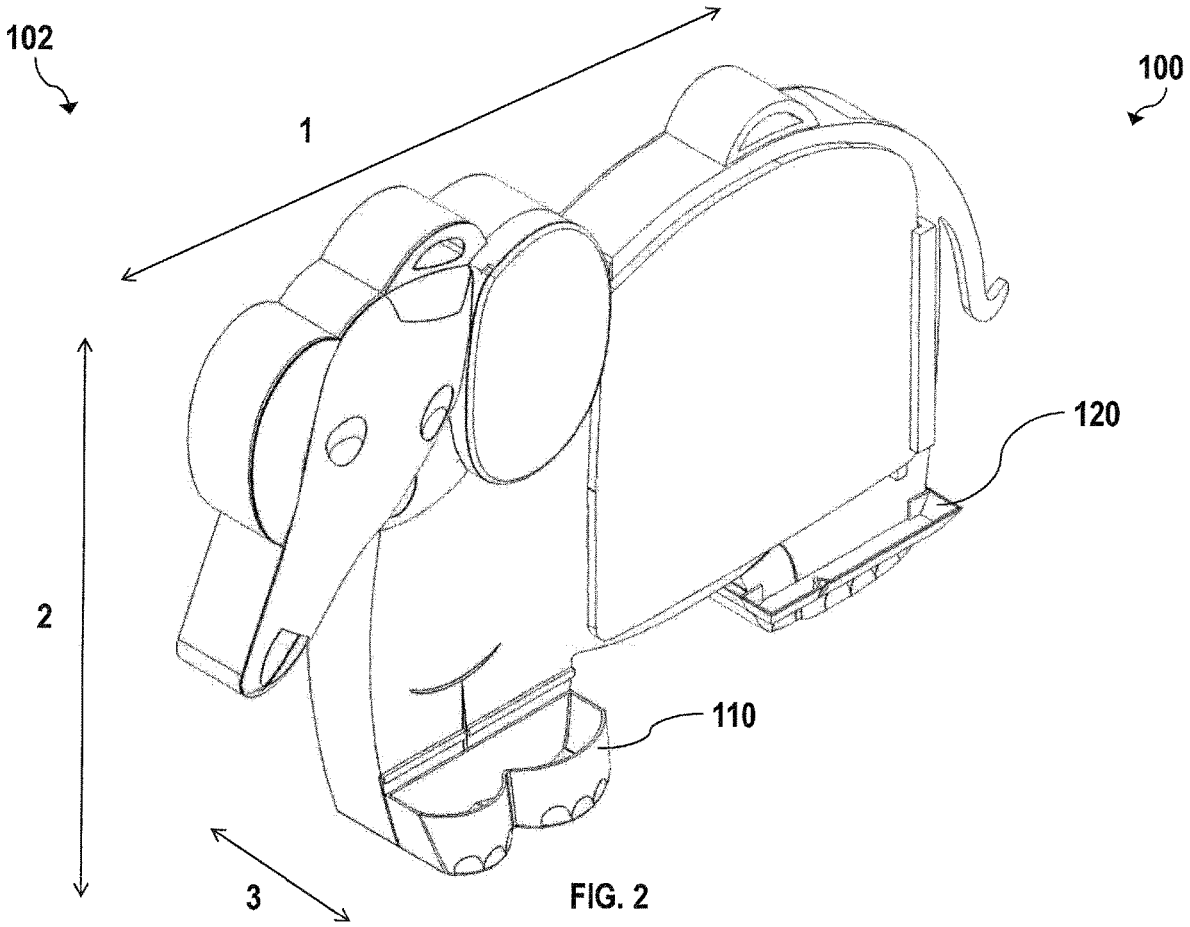
FIG. 2 is an isometric illustration of the apparatus of FIG. 1, in accordance with the first exemplary embodiment of the present disclosure.

FIG. 2 is an isometric illustration of the apparatus 100 of FIG. 1, in accordance with the first exemplary embodiment of the present disclosure. The apparatus 100 has a volume defined by the width 1, length 2, and depth 3 of the housing 102. The width 1 is defined along an axis extending from left to right as shown in FIGS. 1 and 2. In the elephant example, the width 1 is defined along the axis extending from the trunk of the elephant to the tail of the elephant. The length 2 is defined as the axis extending from top to bottom as shown in FIGS. 1 and 2. In the elephant example, the length 2 is defined along the axis extending between the top of the elephant's head and the bottom of the elephant's feet. The depth 3 is defined along the axis perpendicular to the page in FIG. 1. In the elephant example, the depth 3 is defined along the axis extending between the front face of the elephant and the rear of the elephant shown in FIG. 3.

FIG. 2 shows the drawers 110, 120 slidably extended from a closed position to an open position. As shown in FIG. 2, the drawers 110, 120 extend substantially the entire depth of the drawer 110, 120. The drawers 110, 120 are also shown as having a single drawer 110 for the elephant's front feet and a single drawer 120 for the elephant's rear feet. The front feet drawer 110 is bowed along the front surface of the drawer 110 in order to facilitate the opening and closing of the drawer 110. The rear feet drawer 120 is angled along the front surface of the drawer 120 in order to facilitate the opening and closing of the drawer 120.

In one example, the apparatus 100 may have a substantially flat front surface when all of the drawers and other components are in a closed position. As shown in FIGS. 2 and 5B, below, the front surface of the housing 102 may lie substantially on the same plane. This may allow the apparatus 100 to remain closed when being transported, as a user will be less likely to grab openable components or snag the drawers 110, 120. This may also allow the apparatus 100 to be more compact and transportable.

FIG. 3 is a cross-sectional rear illustration of the apparatus 100 of FIG. 1, in accordance with the first exemplary embodiment of the present disclosure. FIG. 3 shows the rear of the housing 102, including a rear surface 190 on which the second writing surface is located. The second writing surface is not viewable from the perspective shown in FIG. 3, but is discussed in greater detail in FIGS. 4-5B. The rear surface 190 may be a substantially planar surface forming a rear portion of the housing 102. The rear surface 190 may be slidably attached to the housing 102. When in a closed position, the rear surface 190 may enclose the cavity within the interior of the housing 102 from the rear side. The rear surface 190 may be guided and held closed by a plurality of extensions 192, 194, 196 located on the exterior rear of the housing 102. The extensions may be shaped as members forming a tongue and groove with the rear surface 190. For example, extensions 192, 194 may be elongated members that guide the rear surface 190 into an aligned position along the length axis of the apparatus 100. Extension 196 may be a shorter member that stops the rear surface 190 from sliding too low on the housing 102. Any suitable system of locking and groove mechanisms may be used to guide the rear surface 190 by the extensions 192, 194, 196. In one example, the rear surface 190 may slide upward to provide access to the interior cavity of the apparatus 100.

FIG. 4 is an exploded view of the apparatus 100 of FIG. 1, in accordance with the first exemplary embodiment of the present disclosure. For purposes of illustration, FIG. 4 is discussed with regard to an apparatus 100 having the appearance of an elephant. However, the qualities, characteristics, and other aspects of the apparatus described herein may be applicable to the apparatus 100 in any suitable form or design, and should be considered to be within the scope of the entire invention. It should be noted that any surfaces or components shown detached from the housing 102 of the apparatus 100 are illustrative only. In one example, all of the components may remain attached by a locking mechanism or a mechanical stopper. Thus, even though the drawers 110, 120, 160 may slide out and the surfaces 140, 180, 150 may slide up or swivel, the apparatus 100 may remain a single piece. In another example, some of the components, such as the moveable components, may be detachable from the housing 102.

The housing 102 may be shaped as an elephant. The housing 102 may be generally planar, having front and back surfaces shaped in the outline of an elephant. The top, side, and bottom surfaces of the housing 102 may have a surface area smaller than the front and back surfaces such that the housing 102 resembles a substantially 2-dimensional elephant. For other shapes and implementations, the housing 102 may resemble a substantially 2-dimensional object. The planar nature of the housing 102 allows the apparatus 100 to be placed flat on a desktop, table, ground, lap, and the like so that the user may securely use the apparatus 100 in use. The front surface of the housing 102 may be generally rigid. In one example, the housing 102 may be formed from a single, unitary piece. In another example, the housing 102 may be formed from a plurality of pieces attached together using heat bonding, glues, epoxies, and the like.

A first drawer 110 is shaped as the elephant's front feet. The first drawer 110 may be a single drawer shaped as the two front feet of the elephant, or it may be a plurality of drawers.

The first drawer 110 may have a depth, shown in FIG. 2, substantially the depth of the housing 102. The first drawer 110 may fit within a cavity 112 of substantially the same volume enclosed by the first drawer 110. The cavity 112 may be located within at least a portion of the elephant's front feet. When the housing 102 is shaped as another form, the cavity 112 may be located within a portion of the housing having substantially the same volume as the first drawer 110. The cavity 112 may be a single cavity when the first drawer 110 is a single drawer, or it may be a divided cavity 112 when the first drawer 110 is a plurality of drawers. For example, if the first drawer 110 is two separate drawers—one for each foot—the cavity 112 may be divided into two spaces—one for each drawer. The cavity 112 may include a track for the first drawer 110 to guide it as it is extended from the housing 102. When extended, the first drawer 112 may extend substantially the entire depth of the first drawer 112 to allow a user to access the full volume of the first drawer 112. When closed, the first drawer 112 may be substantially flat against the front surface of the housing 102. A front surface of the first drawer 112 may be shaped, styled, colored, or decorated to resemble the elephant's front feet. When closed, the first drawer 112, together with the housing 102, may give the appearance of an elephant's front legs and front feet.

A second drawer 120 is shaped as the elephant's rear feet. The second drawer 120 may have any of the characteristics of the first drawer 110 described above. The second drawer 120 may be sized differently than the first drawer 110. As shown in FIG. 4, the second drawer 120 may be wider than the first drawer 110 to accommodate different sizes of artistic supplies. The second drawer 120 may be located inside a cavity 122 that may be substantially the same depth as the housing 102. The cavity 122 may be located within a portion of the elephant's rear feet. The second drawer 120 may be shaped, styled, colored, or decorated to resemble the elephant's rear feet. When closed, the second drawer 120, together with the housing 102, may give the appearance of an elephant's rear legs and rear feet.

A hook 130 is shaped as the elephant's tail. When the apparatus 100 is shaped as another object, the hook 130 may be shaped as another feature of the object. For instance, if the apparatus 100 is shaped as an animal, the hook 130 may be shaped as the animal's tail. If the apparatus 100 is shaped as a cluster of grapes, the hook 130 may be shaped as the stem of the cluster of grapes. In one example, the hook 130 may not be shaped as a feature of the object, but may simply be shaped as a hook 130. For instance, if the object is a basketball, the hook 130 may not be shaped as any feature of the basketball. The hook 130 may be upwardly concave to allow a user to hang items from the hook 130.

A drawer 160 is shaped as the elephant's trunk. The drawer 160 may be sized to appear as a portion of the elephant's trunk. The drawer 160 may have any of the characteristics of the first and second drawers 110, 120 described above. In one example, the drawer 160 may encompass a smaller volume than the first or second drawers 110, 120, and may be sized to accommodate small artistic supplies. The drawer 160 may extend outwardly from the housing 102, like the first and second drawers 110, 120. In one example, the drawer 160 may extend through the elephant's trunk. The drawer 160 may be located within a cavity 162 shaped as a portion of the elephants trunk. The cavity 162 may be located at any portion of the trunk. In one example, the drawer 160 and the cavity 162 may be substantially the same size as the elephant's trunk, allowing the drawer 160 to hold long artistic supplies such as brushes, pens, pencils, and the like.

In one example, the apparatus 100 may include a plurality of drawers 110, 120, 160 within the housing. The drawers may be located at any suitable point along the housing 102. In one example, the plurality of drawers 110, 120, 160 may be sized and shaped to resemble visual features of an object depicted by the apparatus 100. For instance, if the object depicted by the apparatus 100 is a tree, the plurality of drawers 110, 120, 160 may be leaves, branches, or knots of the tree. If the object depicted by the apparatus 100 is a house, the plurality of drawers 110, 120, 160 may be doors, windows, or eaves of the house.

A first writing surface 140 is shaped as the elephant's body and slidably located on an exterior surface of the housing 102. FIG. 4 shows the first writing surface 140 sized and shaped to resemble a portion of the elephant's torso, namely the back, stomach, and sides, referred to here generally as "body." The first writing surface 140 may be substantially flat to allow a user to write, draw, or otherwise mark it. In one example, the first writing surface 140 may be a dry erase board capable of erasably receiving marking from a dry erase marker. In one example, the first writing surface 140 may also be magnetic to allow the user to stick or hang items from the first writing surface 140. The first writing surface 140 may have a different color, texture, and appearance from the housing 102. In the elephant example, the first writing surface 140 may have a smooth, white appearance, while the housing may appear rough and gray. The first writing surface 140 may be a portion of the front surface of the housing 102. In one example, the first writing surface 140 may have a surface area of at least 30% of the front surface of the apparatus 100. In another example, the first writing surface 140 may have dimensions of about 12"×8".

A second writing surface 180 may be shaped as the elephant's body and slidably located within the housing 102. The second writing surface 180 may be located on an interior portion of the rear surface 190 shown in FIG. 3, such that the rear surface 190 is exterior to the housing 102, but the second writing surface 180 is interior to the housing 102. The second writing surface 180 may be substantially the same size as the first writing surface 140. In one example, the second writing surface 180 may be the same type of writing surface as the first writing surface 140, for instance, a dry erase board. In another example, the second writing surface 180 may be a different type of writing surface from the first writing surface 140. For instance, the first writing surface 140 may be a dry erase board, and the second writing surface 180 may be a chalk board. Other types of writing surfaces are included within the scope of this disclosure, and are discussed relative to FIG. 1, above. The second writing surface 180 may be slidably located within the housing 102. The rear surface 190 may be slid upward, downward, or away from the housing 102 to reveal the cavity 142 within the housing 102. The cavity 142 may have substantially the same surface area as the first and second writing surfaces 140, 180.

The first writing surface 140 may slide from a first writing position to a second writing position to make the second writing surface 180 accessible. In the first writing position, the first writing surface 140 may be located along the housing 102, as shown in FIG. 1. The second writing surface 180 may be located along the housing 102, as shown in FIG. 3. The first writing surface 140 may be considered to be in a closed or storage position when in the first writing position. The first writing position allows a user to access and use the first writing surface 140. A user may slide the first writing surface 140 from the first writing position to the second writing position, shown in FIG. 5A. The second writing position may expose the entire second writing surface 180 and the entire cavity 142. In the example shown in FIG. 4, the first writing surface 140 slides up from the first writing position into the second writing position. The second writing surface 180 is located within the housing 102 at the rear portion of the cavity 142. The second writing surface 180 may be marked on by a user when the first writing surface 140 is the second writing position.

In one example, the second writing surface 180 may be slid from the first writing position to a third writing position. This is shown in greater detail in FIG. 5D.

In one example, the first and second writing surfaces 140, 180 may be interchangeable. For example, a user may interchange the position of the first writing surface 140 with the second writing surface 180 to allow the user to have primary access to the second writing surface 180. In such an example, the first and second writing surfaces 140, 180 may be designed to slide interchangeably within the housing 102.

A hidden cavity 152 may be shaped as the elephant's ear. The hidden cavity 152 may be accessible by sliding a surface 150 shaped as the elephant's ear to reveal the hidden cavity 152 directly underneath and within the housing 102. A depth of the hidden cavity 152 may be at least a portion of the depth 3 of the housing 102 as shown in FIGS. 2 and 6B. In one example, the hidden cavity 152 may have a depth smaller than the housing 102. When the apparatus 100 is shaped as a different object, the hidden cavity 152 may resemble another feature of that object. For example, an apparatus 100 shaped as a car may have a hidden cavity 152 shaped as a tire. The hidden cavity 152 may be shaped as any suitable feature of the housing 102. The hidden cavity 152 may be enclosed by the housing 102 and the surface 150 shaped as the elephant's ear. The surface 150 may slide in at least one direction to reveal the hidden cavity 152. In operation, the surface 150 may remain attached to the housing 102 after sliding.

When all of the drawers 110, 120, 160 and surfaces 140, 180, 150 are in a closed position, the apparatus 100 may appear to be an elephant having a head, ears, trunk, body, front feet, rear feet, and tail. The drawers and surfaces 110, 120, 160, 140, 180, 150 may create the appearance by providing an alignment and positioning of the physical features of the elephant. When one or more of the drawers and surfaces 110, 120, 160, 140, 180, 150 are in an open or extended position, the elephant may appear to be missing the one or more features corresponding to the open or extended drawers and surfaces.

FIG. 5A is a front view illustration showing the interior of the apparatus 100 of FIG. 1, in accordance with the first exemplary embodiment of the present disclosure. The first writing surface 140 is shown having been slid from a first writing position to a second writing position. The first writing position is shown in FIG. 1, wherein the first writing surface 140 is lowered and located across the housing 102. In the second writing position, the first writing surface 140 may be extended upward, sideways, or downward in order to reveal the cavity 142 within the housing 102.

In operation the first writing surface 140 may be guided by at least one front extension 148, 149, which may be a member extending outward from the surface of the housing 102. As discussed relative to FIG. 3, this member may include an elongated member 148, a short member 149, or some combination thereof. The front extensions 148, 149 may create a tongue and groove guide that allows the first writing surface 140 to slidably extend along a controlled, determined path. The short extension member 149 may hold the first writing surface 140 in place against gravity to prevent it from sliding further downward.

In one example, the first writing surface 140 may additionally include magnetic components that allow magnets 144 to be magnetically affixed to the first writing surface 140. This may allow a user to temporarily affix artwork 146 or other light materials to the first writing surface 140 using one or more magnets 144. This may allow the user to display their work 146, study from an example work, or simply organize the material.

FIG. 5B is an isometric illustration showing the interior of the apparatus 100 of FIG. 1, in accordance with the first exemplary embodiment of the present disclosure.

In one example, the cavity 142 may be an empty cavity. In another example, the cavity 142 may include retaining pockets 500 sized to retain artistic supplies, such as pens, pencils, markers, brushes, and the like, in place within the cavity while the apparatus 100 is in motion. The retaining pockets 500 may be substantially fixed in their size and location, and may be made from the same material as the housing 102. In one example, the retaining pockets may be made from an elastic material which expands and contracts to allow the artistic supplies to be added and removed. The cavity 142 may further include one or more shelves 502 for resting supplies or for supporting the user while writing on the second writing surface 180.

FIG. 5B shows an exemplary implementation of a tongue and groove design for guiding and controlling the sliding of the first writing surface (not shown). On the left side of the cavity 142, a groove 506 is shown formed into the housing 102. The groove 506 may extend from the top surface of the housing 102 down into the cavity 142. The groove 506 may allow a tongue on the first writing surface to be guided along the length of the groove 506. On the right side of the cavity 142, a tongue 148 is shown on the exterior surface of the housing 102. The tongue 148 may run at least a portion of the length of the housing 102. In operation, the tongue 148 may align with a groove in the first writing surface to guide the first writing surface and hold it in place while in use. A tongue on the first writing surface may likewise align with the groove 504 located between the tongue 148 and the housing 102. In this way, the first writing surface may be securely guided and fastened to the housing 102 of the apparatus 100.

Figure 5C:
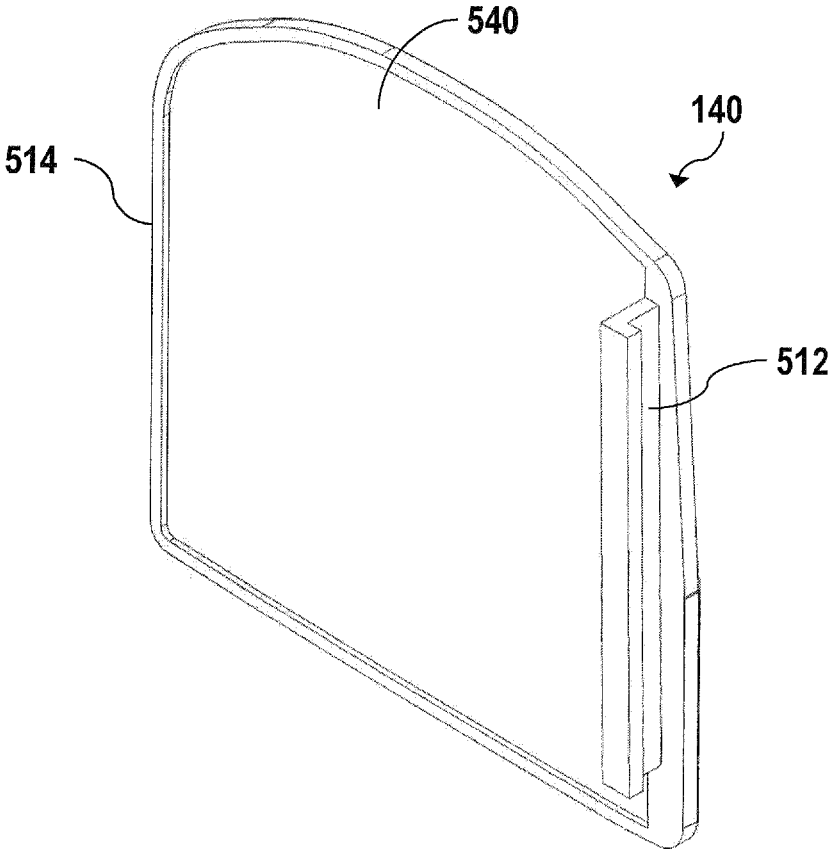
FIG. 5C is an isometric illustration showing the interior of the first writing surface of the apparatus of FIG. 1, in accordance with the first exemplary embodiment of the present disclosure.

FIG. 5C is an isometric illustration showing the interior 540 of the first writing surface 140 of the apparatus 100 of FIG. 1, in accordance with the first exemplary embodiment of the present disclosure. FIG. 5C may be best understood in light of FIG. 5B, above, which shows a groove 506 and a tongue 148 located on and around the cavity 142 of the apparatus 100. FIG. 5C shows a tongue 512 on the first writing surface 140 which may fit with the groove 506 in FIG. 5B. Likewise, the edge 514 of the first writing surface 140 may fit within the groove 504 located between the tongue 148 and the housing 102 shown in FIG. 5B. This may allow the first writing surface 140 to be securely guided and fastened to the housing 102 of the apparatus 100. The first writing surface 140 may slide from a first writing position to a second writing position using this series of tongues and grooves.

It should be noted that the tongue and groove series shown in FIGS. 5A-5C are exemplary, and that other sliding implementations are contemplated to be within the scope of this disclosure.

Figure 5D:
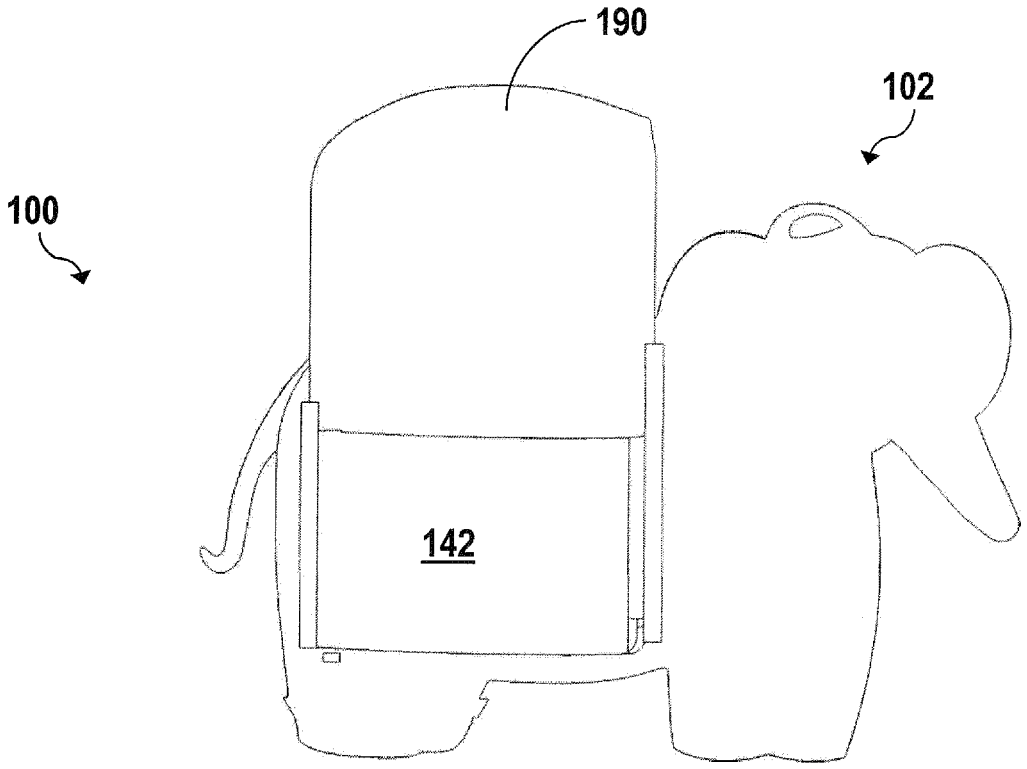
FIG. 5D is a rear view illustration showing the apparatus of FIG. 1 in a third writing position, in accordance with the first exemplary embodiment of the present disclosure.

FIG. 5D is a rear view illustration showing the apparatus 100 of FIG. 1 in a third writing position, in accordance with the first exemplary embodiment of the present disclosure. In the third writing position, the rear surface 190 containing the second writing surface 180, shown in FIG. 4, may be slid from an initial position shown in FIG. 3 to a raised position. The third writing position may reveal the cavity 142 within the housing 102. In use, the third writing position may allow a user to write on the second writing surface 180, shown in FIG. 4, while the first writing surface 140 remains in an initial position, shown in FIG. 1. This may allow the user to access any desired writing surface.

Figure 6A:
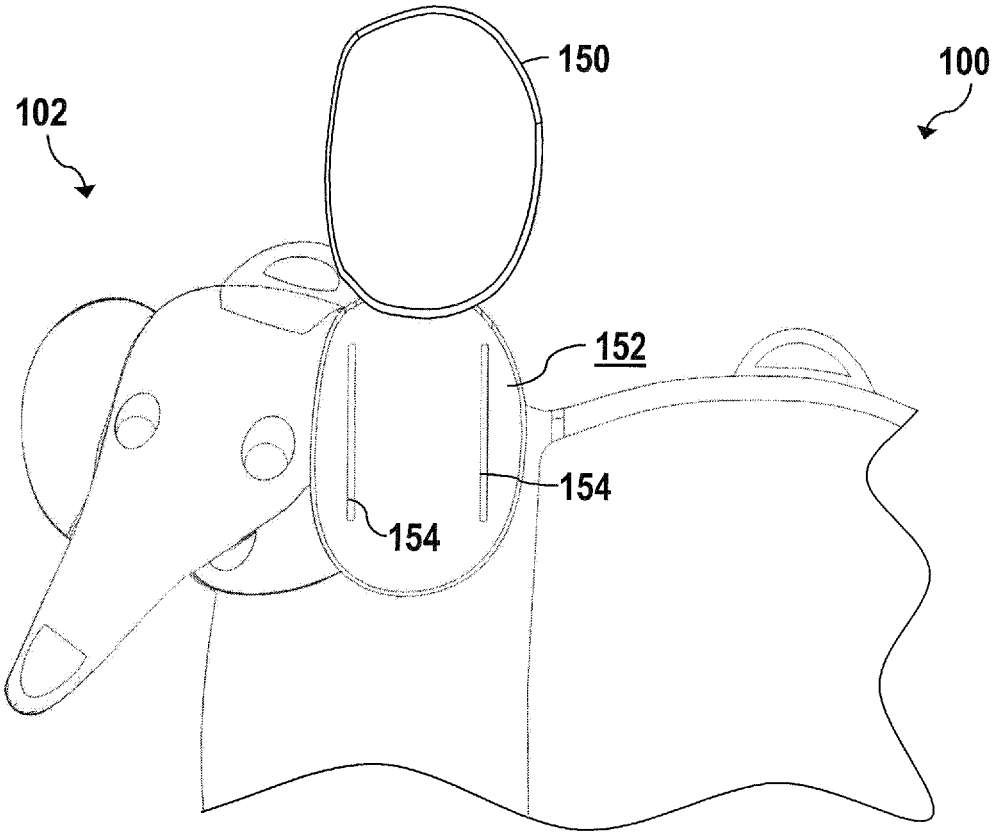
FIG. 6A is a close-up front view illustration showing an interior space of the apparatus of FIG. 1, in accordance with the first exemplary embodiment of the present disclosure.
Figure 6B:
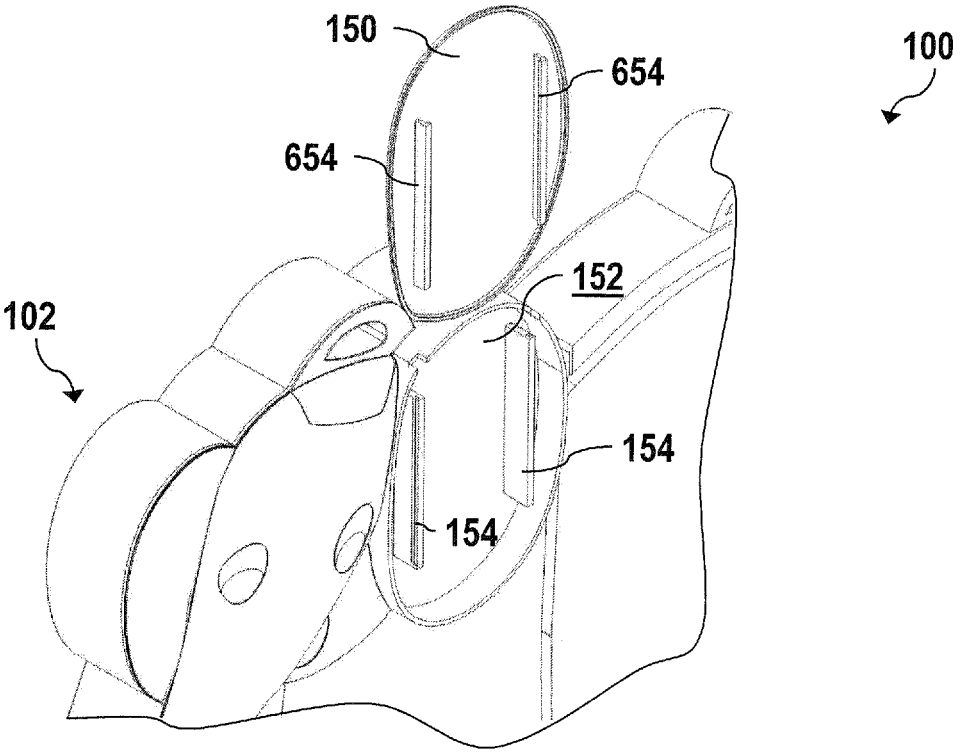
FIG. 6B is a close-up isometric illustration showing the interior space of the apparatus of FIG. 6A, in accordance with the first exemplary embodiment of the present disclosure.

FIG. 6A is a close-up front view illustration showing an interior space of the apparatus 100 of FIG. 1, in accordance with the first exemplary embodiment of the present disclosure. FIG. 6A shows the hidden cavity 152 located within the housing 102. In the elephant example shown, the hidden cavity 152 may be located behind the surface 150 shaped as the elephant's ear. In other examples, the hidden cavity 152 may be located behind other portions of the housing 102, depending on the shape and implementation of the apparatus 100. The surface 150 shaped as the elephant's ear may slide upward, downward, or sideways, or it may swing or pivot. In the example shown in FIG. 6A, the surface 150 slides along two tongues 154 located within the hidden cavity 152. The hidden cavity 152 may be smaller than the cavity 142 accessible by sliding the first or second writing surfaces. The hidden cavity 152 may be sized to hold comparatively smaller artistic supplies, including papers, stickers, materials, cloth, and the like. The hidden cavity 152 may also store chalk, tape, crayons, erasers, and other small supplies.

FIG. 6B is a close-up isometric illustration showing the interior space of the apparatus 100 of FIG. 6A, in accordance with the first exemplary embodiment of the present disclosure. The hidden cavity 152 shown behind the surface 150 shaped as the elephant's ear may provide a space for storage of artistic supplies. The surface 150 is shown rotated 180° in order to illustrate an exemplary tongue and groove implementation that may be used to guide and secure the surface 150 in operation. The surface 150 may include, on the interior surface, a number of members 654 spaced and sized to correspond to a number of tongues 154 within the hidden cavity 152. The members 654 and the tongues 154 may fit together to provide a biased guide for the surface 150 as it slides. As discussed relative to FIGS. 5A-5C, FIGS. 6A-6B show an exemplary implementation for guiding and securing the surface 150. In practice, other tongue and groove systems may be used.

In one example, the apparatus 100 may be used in conjunction with an application for teaching the user artistic skills. For instance, young children may be taught about colors, shapes, textures, materials, media, and the like. More advanced children may be taught about perspective, dimensions, techniques, and the like. Yet more advanced users may be taught the styles of particular artists or movements within an art form. The application may include examples that can be viewed and replicated by the user using the apparatus 100. The application may include tasks or assignments. The application may provide custom instruction based on the shape and functionality of the apparatus 100. For instance, the application may provide education and assignments tailored to the elephant example, such as elephant-themed assignments, elephant-oriented colors and shapes, and the like.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A self-contained artistic storage and creation apparatus, comprising:

a housing having a volume defined by a width, length, and depth;

at least one drawer slidably located within the housing, wherein the at least one drawer fits within the depth of the housing, and wherein the at least one drawer is sized to contain artistic supplies;

a first writing surface slidably located on an exterior surface of the housing;

a second writing surface accessible through the housing and slidable about an exterior rear of the housing, wherein the second writing surface is accessible by sliding the first writing surface from a first writing position to a second writing position; and a cavity located within the housing and between the first and second writing surfaces, wherein the cavity extends through a portion of the length and depth of the housing, and wherein the cavity is accessible by sliding at least one from the set of: the first writing surface and the second writing surface.

2. The self-contained artistic storage and creation apparatus of claim 1, comprising at least two drawers slidably located within the housing, wherein at least a first drawer has a different size than at least a second drawer.

3. The self-contained artistic storage and creation apparatus of claim 1, wherein the first writing surface is one selected from the set of: a dry erase board, a chalk board, erasable paper, removable paper, and magnetic sketch board.

4. The self-contained artistic storage and creation apparatus of claim 1, wherein the second writing surface is one selected from the set of: a dry erase board, a chalk board, erasable paper, removable paper, and magnetic sketch board.

5. The self-contained artistic storage and creation apparatus of claim 1, wherein the first writing surface is magnetic.

6. The self-contained artistic storage and creation apparatus of claim 1, further comprising at least one handle.

7. The self-contained artistic storage and creation apparatus of claim 1, further comprising a hook.

8. The self-contained artistic storage and creation apparatus of claim 1, wherein the first and second writing surfaces are different types of writing surfaces.

9. The self-contained artistic storage and creation apparatus of claim 1, wherein the second writing surface is accessible by sliding the second writing surface from a first writing position to a third writing position.

10. The self-contained artistic storage and creation apparatus of claim 1, further comprising a hidden cavity within the housing, wherein the hidden cavity is accessible by sliding a surface of the housing.

11. A self-contained artistic storage and creation apparatus having the appearance of an elephant, comprising:

a housing shaped as an elephant, the housing having a volume defined by a width, length, and depth;

a first drawer shaped as the elephant's front feet, wherein the first drawer fits within the depth of the housing;

a second drawer shaped as the elephant's rear feet, wherein the second drawer fits within the depth of the housing;

a hook shaped as the elephant's tail;

a drawer shaped as at least a portion of the elephant's trunk;

a writing surface shaped as the elephant's body and slidably located on an exterior surface of the housing; and a cavity located within the housing and directly interior to the writing surface, wherein the cavity extends through a portion of the length and depth of the housing, and wherein the cavity is accessible by sliding the writing surface.

12. The self-contained artistic storage and creation apparatus of claim 11, wherein the first drawer and the second drawer are different sizes.

13. The self-contained artistic storage and creation apparatus of claim 11, wherein the drawer shaped as at least a portion of the elephant's trunk is smaller than the first drawer and the second drawer.

14. The self-contained artistic storage and creation apparatus of claim 11, wherein the writing surface is one selected from the set of: a dry erase board, a chalk board, erasable paper, removable paper, and magnetic sketch board.

15. The self-contained artistic storage and creation apparatus of claim 11, wherein the writing surface is magnetic.

16. The self-contained artistic storage and creation apparatus of claim 11, further comprising a second writing surface accessible through the housing and slidable about an exterior rear of the housing, wherein the second writing surface is accessible by sliding the first writing surface from a first writing position to a second writing position.

17. The self-contained artistic storage and creation apparatus of claim 16, wherein the second writing surface is one selected from the set of: a dry erase board, a chalk board, erasable paper, removable paper, and magnetic sketch board.

18. The self-contained artistic storage and creation apparatus of claim 16, wherein the first and second writing surfaces are different types of writing surfaces.

19. The self-contained artistic storage and creation apparatus of claim 16, wherein the second writing surface is accessible by sliding the second writing surface from a first writing position to a third writing position.

20. The self-contained artistic storage and creation apparatus of claim 11, further comprising at least one handle.

* * * * *